United States Patent [19]

Ashworth

[11] 4,222,457

[45] Sep. 16, 1980

[54] HYDRAULIC PLATFORMS

[75] Inventor: Denis H. Ashworth, Wolverhampton, England

[73] Assignee: Simon Engineering Dudley Ltd., Dudley, England

[21] Appl. No.: 22,032

[22] Filed: Mar. 19, 1979

[30] Foreign Application Priority Data

Mar. 29, 1978 [GB] United Kingdom ..... 12328/78

[51] Int. Cl.[2] ..... B66F 11/04

[52] U.S. Cl. ..... 182/2; 212/238

[58] Field of Search ..... 182/2, 141, 148; 212/144, 17

[56] References Cited

U.S. PATENT DOCUMENTS

| | | | |
|---|---|---|---|
| 3,064,754 | 11/1962 | Broderson | 182/2 |
| 3,379,279 | 4/1968 | Slusher | 182/2 |
| 3,461,989 | 8/1969 | Prescott | 182/2 |
| 3,604,533 | 9/1971 | Eckels | 182/2 |
| 3,844,378 | 10/1974 | Balogh | 182/2 |

*Primary Examiner*—Reinaldo P. Machado

*Attorney, Agent, or Firm*—Norris & Bateman

[57] ABSTRACT

An hydraulic platform comprises a support structure which mounts a boom assembly comprising a plurality of booms pivotally connected in end-to-end relationship and carrying on its free end a working platform or cage, hydraulic actuator means for pivoting the booms relative to the supporting structure and one another to carry the working platform or cage to a variety of positions remote from the support structure and having a first boom pivotally connected to the support structure, a second boom pivotally connected to the free end of said first boom, first hydraulic cylinder means for effecting pivoting movement of said first boom relative to the support structure between a first inoperative position and a variety of operative positions, second hydraulic cylinder means connected with said second boom for effecting pivoting movement of said second boom relative to said first boom, said hydraulic cylinder means being secured to a member which is pivotally connected with said support structure at a position offset from the pivotal connection between said first boom and said support structure.

11 Claims, 3 Drawing Figures

HYDRAULIC PLATFORMS

This invention concerns an hydraulic platform of the kind (hereinafter termed of the kind referred to) comprising a support structure which mounts a boom assembly comprising a plurality of booms pivotally connected in end-to-end relationship and carrying on its free end a working platform or cage, hydraulic actuator means for pivoting the booms relative to the supporting structure and one another to carry the working platform or cage to a variety of positions remote from the support structure.

Normally each boom of an hydraulic platform of the kind referred to can only be pivoted relative to the part to which it is connected by actuation of an hydraulic cylinder specifically provided for such purposes. It follows that pivoting movement of the first boom, that is the one connected to the support structure, relative to such structure also causes a change in the angular disposition of the second boom, that is the one connected to the first boom. Such change can cause downward movement of the working platform or cage in response to elevation of the first boom and this can be puzzling to the inexperienced operator.

There have, however, been proposals whereby pivoting movement of the first boom relative to the support structure automatically causes compensating pivoting movement of the second boom relative to the first boom. The second boom is of course pivotally moveable relative to the first boom independently of movement of the first boom by means of an hydraulic actuator in known manner.

It is an object of the present invention to provide means for achieving such compensating movement in a particularly simple and convenient manner.

According to the present invention there is provided an hydraulic platform of the kind referred to having a first boom pivotally connected to the support structure, a second boom pivotally connected to the free end of said first boom, first hydraulic cylinder means for effecting pivoting movement of said first boom relative to the support structure between a first inoperative position and a variety of operative positions, second hydraulic cylinder means connected with said second boom for effecting pivoting movement of said second boom relative to said first boom, said second hydraulic cylinder means being secured to a member which is pivotally connected with said support structure at a position offset from the pivotal connection between said first boom and said support structure.

The invention will be further apparent from the following description with reference to the several figures of the accompanying drawings which show, by way of example only, one form of hydraulic platform embodying the invention.

Figure 1:
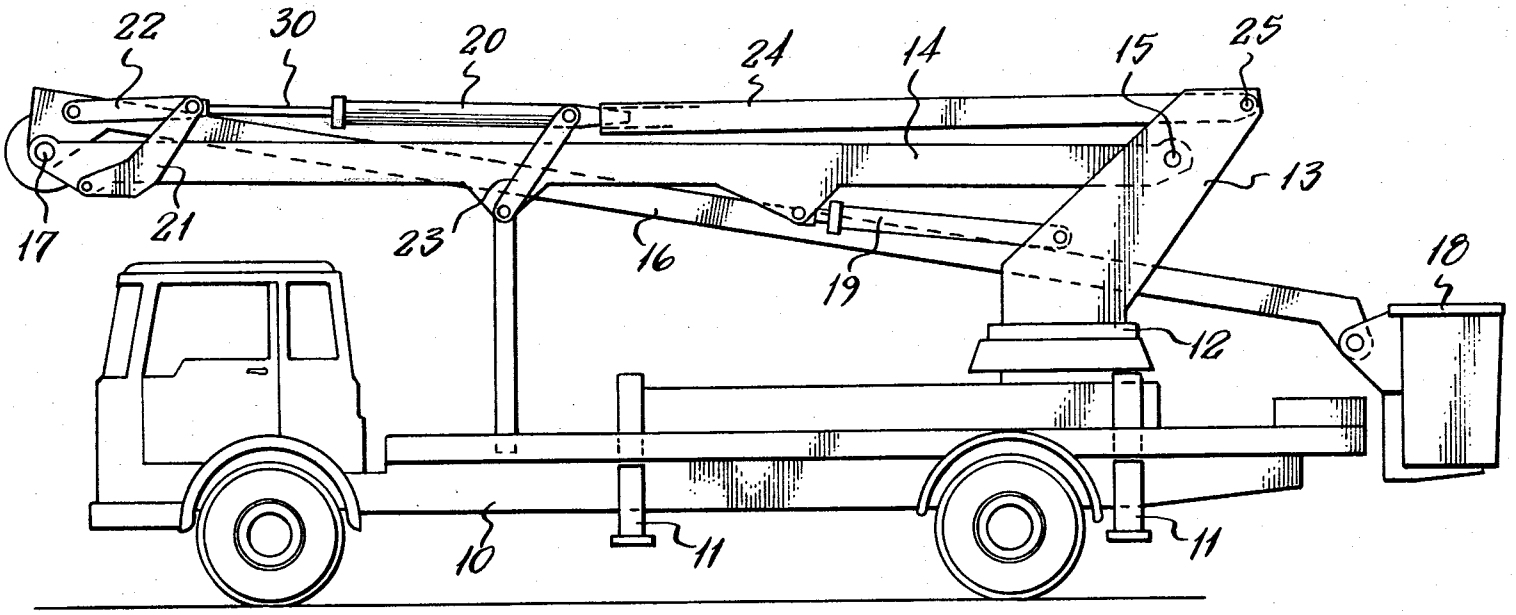
FIG. 1 shows a side elevation of the hydraulic platform.
Figure 3:
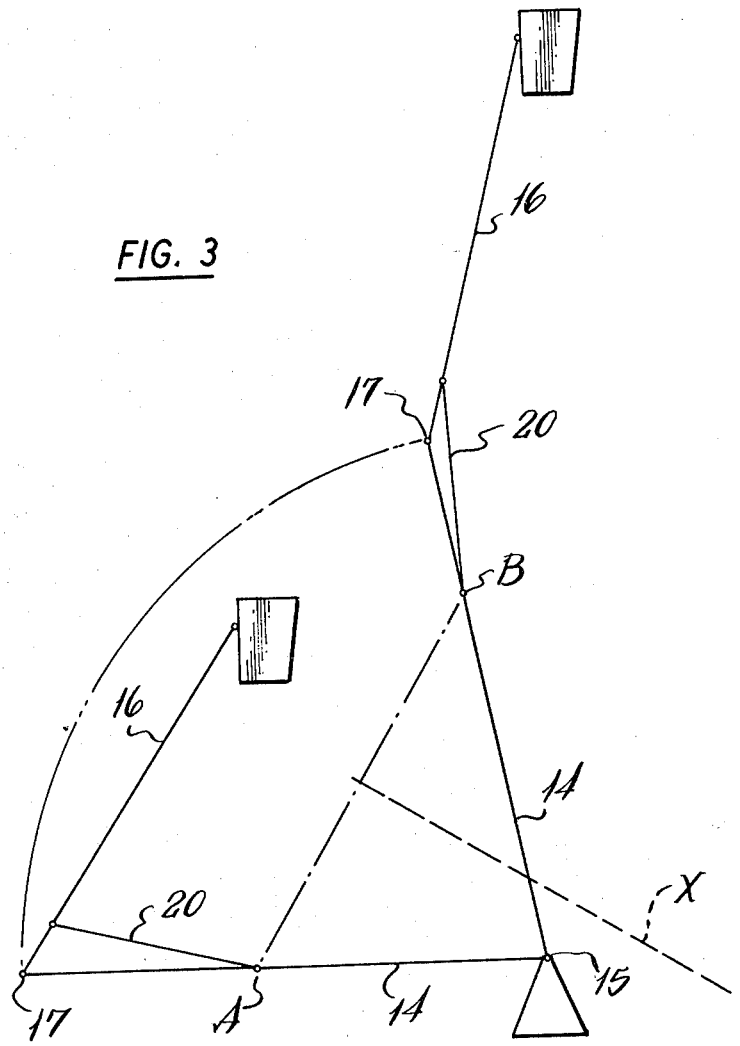

and FIG. 3 is a diagram to illustrate how the boom assembly of the hydraulic platform of FIG. 1 can be designed to achieve a desired operational result.

The hydraulic platform to be described is of the kind which is mounted on a road vehicle and which includes a boom assembly which can be moved from an inoperative or travelling position wherein the booms extend in a generally horizontal direction and a variety of operative positions wherein the working platform or cage is positioned at an elevated position relative to the road vehicle.

Turning now to the drawings it will be seen that the road vehicle 10 is, in known manner, equipped with hydraulically extendible and retractable ground-engaging stabilising jacks 11. An hydraulically rotatable turntable 12 is carried on the chassis of the vehicle 10 and mounts a support structure 13 for the boom assembly.

Figure 2:
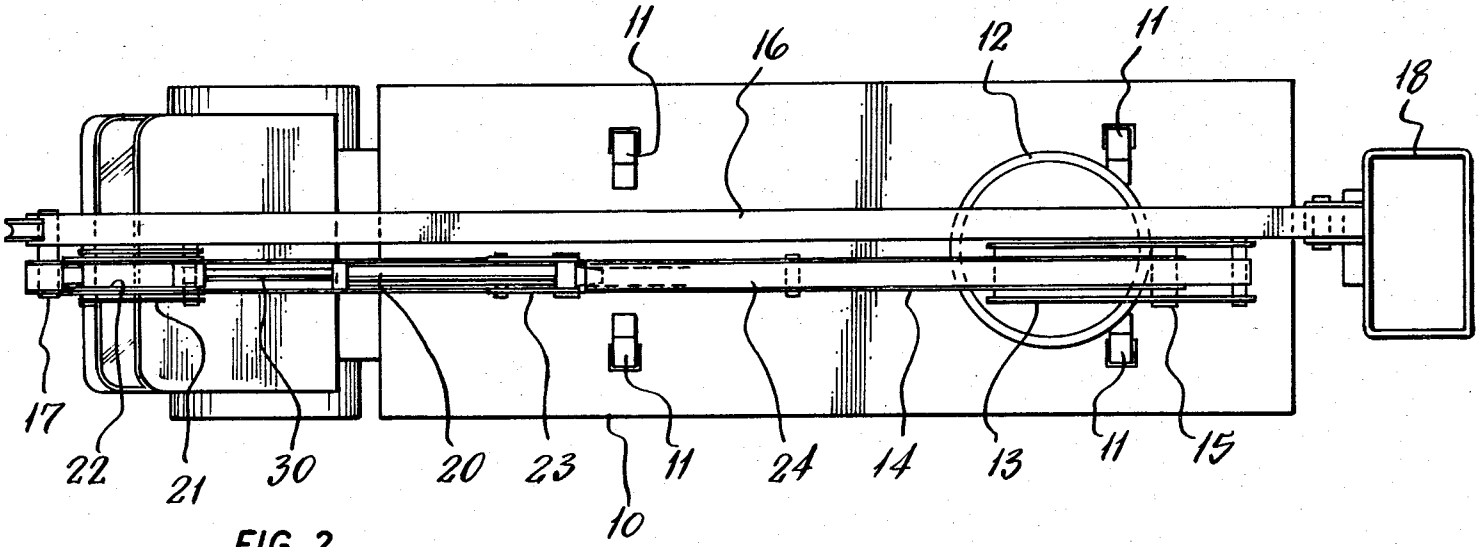
FIG. 2 shows a plan view of the hydraulic platform of FIG. 1.

The boom assembly is, in this example, comprised by two booms. The first boom 14 is pivotally connected at 15 to the support structure 13 and the second boom 16 is pivotally connected at 17 to the free end of the first boom 14 in such a manner that the two booms lie in separate spaced but adjacent vertical planes as best seen from FIG. 2. A working platform or cage 18 is pivotally connected to the free end of the second boom 16 and means of any suitable known kind is provided for ensuring that the working platform or cage 18 remains level regardless of the angular dispositions of the booms 14 and 16.

A first double-acting hydraulic cylinder 19 extends between the support structure 13 and the first boom 14 and can be extended to move the first boom between its generally horizontal inoperative travelling position as shown in FIG. 1 and a variety of elevated positions wherein its free end is located above the level of the support structure 13.

A second double-acting hydraulic cylinder 20 is provided and has its ram connected to the first and second booms 14 and 16 by pivoted links 21 and 22 respectively and is actuable to cause pivoting movement of the second boom 16 relative to the first boom 14.

The hydraulic cylinder 20 is connected by a pivoted link 23 to the first boom 14 for a purpose which will now be explained.

A compensating bar 24 is pivotally connected at 25 to the support structure 13 at a position offset from the pivotal connection 15 between the first boom 14 and the support structure 13 and extends generally parallel with the first boom 14 and has its end remote from the support structure 13 connected to the hydraulic cylinder 20.

It will be understood that as the first boom 14 is pivoted relative to the support structure 13 there will be relative lengthwise movement between the bar 24 and boom 14, thus to cause displacement of the hydraulic cylinder 20 as a whole longitudinally of the boom 14 and hence swinging movement of the boom 16 relative to the boom 14. The longitudinal movement of the hydraulic cylinder 20 is, of course, accommodated by pivoting movement of the link 23.

The geometry of the arrangement can be chosen to achieve a desired operational result as will now be explained with reference to FIG. 3.

It is first necessary to define two different desired configurations for the boom assembly with the hydraulic cylinder 20 fully extended in both such configurations. Thus, for example, in FIG. 3 a first configuration for the boom assembly wherein the first boom 14 extends generally horizontally from the pivot point 15 and wherein the second boom 16 extends upwardly from the free end of the first boom 14 at an angle of approximately 45° with the cylinder 20 fully extended and meeting the boom 14 at A is shown. A second configuration is also shown wherein the boom 14 extends generally vertically from the pivot point 15 and wherein the second boom 16 extends generally vertically from the pivot point 17 with the hydraulic cylinder 20 fully extended and meeting the first boom 14 at B. The line between the points A and B can be bisected at right angles to give the line X along which the pivot point 25 must be located to ensure that movement of the boom from the first configuration to the second configuration will take place automatically by extension of the hydraulic cylinder 19 alone.

A preferred geometry gives generally vertical movement of the working platform or cage 18 by actuation of the cylinder 19 alone.

An important advantage with this compensated design arises in that if the throw of the cylinder 20 is sufficiently limited, lowering of the working platform or cage to a position adjacent the ground permitting an operator to mount or demount is prevented without first lowering the boom 14. This can be achieved with very little loss of flexibility of total movement of the working platform or cage 18 and is an important safety feature in minimising the risk of the vehicle being driven with the joint between the first and second booms at an elevated position where it might strike an obstruction such as a bridge.

Where the hydraulic cylinder 20 is not sufficiently short to achieve this result, a sleeve such as that shown at 30 may be fitted over its ram artificially to limit its throw. In this latter case the sleeve 30 could be removeable so that the full range of movement of the working platform or cage could optionally be obtained if required.

It will be appreciated that it is not intended to limit the invention to the above example only, many variations, such as might readily occur to one skilled in the art, being possible without departing from the scope of the appended claims.

Thus, for example, the invention may be applied to hydraulic platforms which form so-called viaduct inspection units wherein the working platform or cage can be moved to operative positions below the support structure or to hydraulic platforms of the kind wherein the working platform or cage is arranged to travel in a generally horizontal direction relative to the support structure.

Again, for example, the hydraulic cylinder 20 need not be connected by a pivoted link to the first boom, but could be mounted in a slide secured to the first boom.

The geometry of the boom system can be as desired but in general the most useful arrangements will be where the second boom moves from a position wherein it makes an angle of less than 180° with the first boom to a position wherein it is substantially at 180° with the first boom as the first boom moves from its inoperative position to an operative position substantially displaced from the inoperative position by 90° under the action of the first hydraulic cylinder means and with the second hydraulic cylinder means fully extended throughout.

What is claimed is:

1. A hydraulic platform comprising a support structure which mounts a boom assembly comprising a plurality of booms pivotally connected in end-to-end relationship and carrying on its free end a working platform or cage, hydraulic actuator means for pivoting the booms relative to the supporting structure and one another to carry the working platform or cage to a variety of positions remote from the support structure and having a first boom pivotally connected to the support structure, a second boom pivotally connected to the free end of said first boom, first hydraulic cylinder means for effecting pivoting movement of said first boom relative to the support structure between a first inoperative position and a variety of operative positions, second hydraulic cylinder means connected with said second boom for effecting pivoting movement of said second boom relative to said first boom, said second hydraulic cylinder means being secured to a member which is pivotally connected with said support structure at a position offset from the pivotal connection between said first boom and said support structure.

2. A hydraulic platform according to claim 1 wherein the pivotal connection between the member secured to said second hydraulic cylinder means and the support structure is so positioned that the second boom moves from a position wherein it makes an angle of less than 180° with the first boom to a position wherein it is substantially at 180° with the first boom as the first boom moves from its inoperative position to an operative position substantially displaced from the inoperative position by 90° under the action of said first hydraulic cylinder means and with the second hydraulic cylinder means fully extended throughout.

3. A hydraulic platform according to claim 2 wherein said angle of less than 180° is approximately 45°.

4. A hydraulic platform according to claim 1 wherein the first boom when in its inoperative position is horizontal or substantially so.

5. A hydraulic platform according to claim 4 wherein the first boom is moveable from its inoperative position to operative positions wherein its free end is located above the level of said support structure.

6. A hydraulic platform according to claim 4 wherein the first boom is moveable from its inoperative position to operative positions wherein its free end is located below the level of said support structure.

7. A hydraulic platform according to claim 5 wherein said second hydraulic cylinder means has a structure so limited as to prevent movement of the free end of the second boom to the general level of the support structure whilst its other end is at an elevated position.

8. A hydraulic platform according to claim 5 wherein mechanical stop means is provided to restrict retraction of said second cylinder means so as to prevent movement of the free end of the second boom to the general level of the support structure whilst its other end is at an elevated position.

9. A hydraulic platform according to a claim 8 wherein said mechanical stop means is comprised by a tube fitted over an exposed portion of the ram of the second cylinder means.

10. A hydraulic platform according to claim 1 wherein said first and second booms are pivotally connected in side-by-side relationship in separate adjacent vertical planes.

11. A hydraulic platform according to claim 1 wherein said support structure is mounted on a turntable which is rotatable about a vertical axis.

* * * * *